US010767548B2

(12) United States Patent
Byun et al.

(10) Patent No.: US 10,767,548 B2
(45) **Date of Patent: *Sep. 8, 2020**

(54) FAILURE DIAGNOSIS METHOD OF COOLANT TEMPERATURE SENSOR FOR VEHICLE

(71) Applicants: Hyundai Motor Company, Seoul (KR); Kia Motors Corporation, Seoul (KR)

(72) Inventors: Jung Sup Byun, Seongnam-si (KR); Seong Kyu Park, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 50 days.

This patent is subject to a terminal disclaimer.

(21) Appl. No.: 16/135,385

(22) Filed: Sep. 19, 2018

(65) Prior Publication Data

US 2019/0353086 A1 Nov. 21, 2019

(30) Foreign Application Priority Data

May 15, 2018 (KR) ..... 10-2018-0055576

(51) Int. Cl.
*F01P 11/16* (2006.01)
*F01P 7/16* (2006.01)
*F02D 41/22* (2006.01)

(52) U.S. Cl.
CPC ..... *F01P 11/16* (2013.01); *F01P 7/167* (2013.01); *F02D 41/222* (2013.01);
(Continued)

(58) Field of Classification Search
CPC ..... F01P 11/16; F01P 7/167; F01P 2025/30; F02D 41/222
See application file for complete search history.

(56) References Cited

U.S. PATENT DOCUMENTS 6,200,021 B1 * 3/2001 Mitsutani ..... F01P 11/16 374/1
2004/0184507 A1 9/2004 Tsukamoto et al.
(Continued)

FOREIGN PATENT DOCUMENTS

| | | | |
|---|---|---|---|
| JP | 2004-137981 | A | 5/2004 |
| WO | WO 01/40636 | A2 | 6/2001 |
| WO | WO 2012/063114 | A1 | 5/2012 |

OTHER PUBLICATIONS

European Search report dated Apr. 18, 2019 for European Patent Application No. 18195412.4.

*Primary Examiner* — Kevin A Lathers
(74) *Attorney, Agent, or Firm* — Morgan, Lewis & Bockius LLP

(57) ABSTRACT

A failure diagnosis method of a coolant temperature sensor for a vehicle, may include determining, by a controller, whether or not it is in a flow stop state that stagnates the flow of coolant by a flow control valve; obtaining, by the controller, an engine outlet coolant model temperature when it is in the flow stop state; and diagnosing, by the controller, as a failure of an engine outlet-side outlet water temperature sensor when the coolant model temperature is equal to or greater than a reference temperature and the flow stop state is maintained by the flow control valve.

15 Claims, 2 Drawing Sheets

(52) U.S. Cl.
CPC ..... *F01P 2025/30* (2013.01); *F01P 2025/32* (2013.01); *F01P 2031/00* (2013.01)

(56) References Cited

U.S. PATENT DOCUMENTS

| | | | | |
|---|---|---|---|---|
| 2012/0137992 | A1* | 6/2012 | Kinomuka ..... | F01P 7/165<br>123/41.08 |
| 2013/0213600 | A1* | 8/2013 | Saitoh ..... | F01P 7/165<br>165/11.1 |

* cited by examiner

FAILURE DIAGNOSIS METHOD OF COOLANT TEMPERATURE SENSOR FOR VEHICLE

CROSS REFERENCE TO RELATED APPLICATION

The present application claims priority to Korean Patent Application No. 10-2018-0055576 filed on May 15, 2018, the entire contents of which is incorporated herein for all purposes by this reference.

BACKGROUND OF THE DISCLOSURE

Field of the Disclosure

The present invention relates to a failure diagnosis method of a coolant temperature sensor for a vehicle, which diagnoses a failure of an outlet water temperature sensor located at an outlet side of an engine, thus preventing an accident risk of a vehicle.

Description of Related Art

In the initial cold condition upon a vehicle start-up, the engine is not good in fuel efficiency compared to a sufficient warm-up condition. This is because the friction of the engine is large due to the high viscosity of the oil in the state where the oil temperature during cold is low; in addition, the temperature of the cylinder wall surface is low to cause a large heat loss to the wall surface; and the combustion stability is reduced.

Accordingly, to enhance the fuel efficiency of the vehicle and enhance the durability of the engine, it is necessary to rapidly increase the temperature of the engine to the normal temperature at the initial start-up stage.

For this purpose, there is a demand for heat management control technology of the engine that utilizes the heat generated by the engine for the engine warm-up as much as possible, and representative technologies include a flow stop valve, an electric water pump, an integrated flow control valve, etc.

Among them, the integrated flow control valve adjusts so that the opening amount of the discharge port connected to each flow path reaches the target value through the control of the motor, and operates an opening or a closing for each port, and as a result, can adjust the flow rate of the coolant flowed in/out through each port.

Accordingly, by performing not only a flow stagnation control for stopping the flow of coolant in the engine through the flow rate adjustment of the coolant, but also finely controlling the flow rate variably, it is possible to first supply the heated coolant to an oil warmer or an ATF warmer, etc. to rapidly increase the temperature of the engine oil, the transmission oil, and the entire engine at the same time, thus optimizing the fast warm-up of the engine.

However, the control of the motor configured for operating the flow control valve is performed based on the coolant temperature measured by the outlet water temperature sensor located at the engine outlet; and when the outlet water temperature sensor fails, the sensing value is not changed and the low coolant temperature value is detected as it is even if the coolant temperature increases.

Accordingly, the flow control valve cannot be released from the initial flow stop state, and thereby, the engine coolant temperature is continuously increased. As a result, there is a problem in that the flow control valve stays in the flow stop state for a long time to cause overheating of the engine coolant, resulting in an accident risk due to engine overheating, and also hindering the safety of the vehicle.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a failure diagnosis method of a coolant temperature sensor for a vehicle, which diagnoses a failure of an outlet water temperature sensor located at an outlet side of an engine, thus preventing an accident risk of the vehicle.

A configuration of the present invention for achieving the object may include a controller determining whether or not it is in a flow stop state that stagnates the flow of coolant by a flow control valve; the controller obtaining an engine outlet coolant model temperature when it is in the flow stop state; and the controller diagnosing as a failure of an engine outlet-side outlet water temperature sensor when the coolant model temperature is equal to or greater than a reference temperature and the flow stop state is maintained by the flow control valve is within a certain range.

The present invention can further include storing a maximum value and a minimum value of the outlet coolant temperature measured by the outlet water temperature sensor; and diagnosing to be a failure of the outlet water temperature sensor when the difference between the maximum value and the minimum value of the outlet coolant temperature.

The present invention can further include counting a flow stop time when it is determined to be the flow stop state; and diagnosing to be a failure of the outlet water temperature sensor when the flow stop time is equal to or greater than a reference time.

The present invention can further include detecting an inlet coolant temperature and an outlet coolant temperature by an inlet water temperature sensor and an outlet water temperature sensor; and diagnosing to be a failure of the outlet water temperature sensor when the inlet coolant temperature is greater than the outlet coolant temperature.

The present invention can further include releasing the flow stop state by operating the flow control valve so that the coolant flows through a discharge port of the flow control valve when it is diagnosed to be a failure of the outlet water temperature sensor.

The releasing the flow stop can operate the flow control valve to the location where the coolant flows as much as possible through the discharge port connected to a heater core.

Through the above configuration, the present invention can diagnose the failure of the outlet water temperature sensor in the flow stop state of the flow control valve to prevent the flow control valve from staying in the flow stop state for a long time and thereby, to prevent overheating of the engine coolant from being caused, thus preventing the accident risk due to engine overheating and increasing the safety of vehicle driving.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
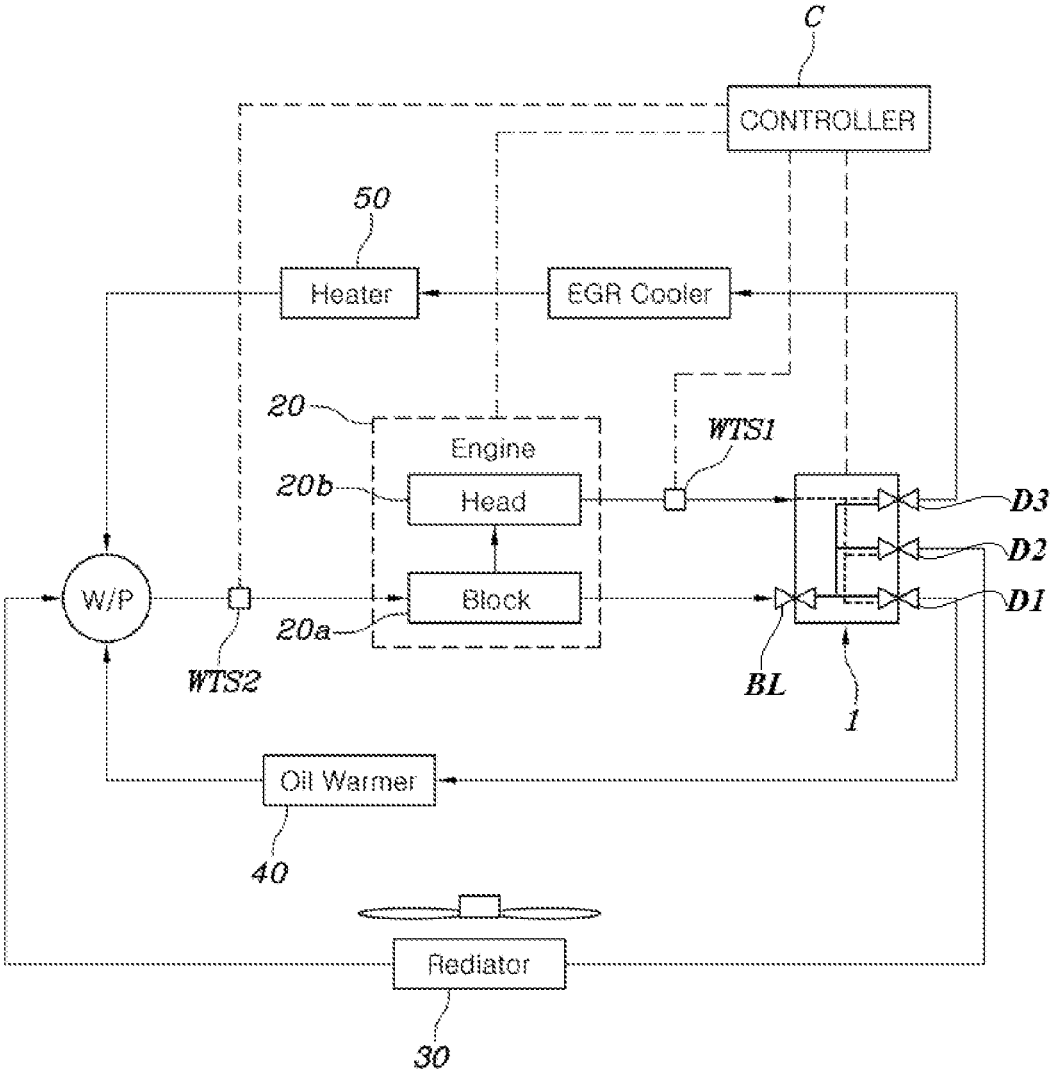
FIG. 1 is a diagram illustrating a cooling circuit for a vehicle applicable to the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION OF THE DISCLOSURE

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Exemplary embodiments of the present invention will be described in detail with reference to the accompanying drawings as follows.

FIG. 1 is a diagram illustrating a configuration of a cooling circuit for a vehicle applicable to the present invention; and an inlet water temperature sensor (WTS2) is disposed on an inlet-side flow path of an engine 20, an outlet water temperature sensor (WTS1) is disposed on an outlet-side flow path of the engine 20, and a flow control valve 1 is disposed at the rear end portion of the outlet water temperature sensor (WTS1).

The flow control valve 1 can be configured so that four-port control can be performed to variably control four ports BL, D1, D2, D3 at once by an independent operation of the valve body provided inside the valve.

For example, the flow control valve 1 is provided with at least three discharge ports D1. D2 and D3, respectively, and each of the discharge ports D1, D2 and D3 is connected to an oil heat exchanger such as an oil warmer 40, etc., a radiator 30, and a flow path where a heater core 50 is located, respectively, to adjust the flow rate of the coolant discharged to these flow paths.

In an exemplary embodiment of the presently claimed invention, the cylinder head 20*b* and the flow control valve 1 are continuously connected.

As such, the coolant outlet of a cylinder block 20*a* of the engine 20 and the coolant outlet of a cylinder head 20*b* may be independently connected to the flow control valve 1, respectively. Furthermore, a block port BL is provided in a portion of the flow control valve 1, and the block port may be connected to the coolant outlet of the cylinder block 20*a* to adjust the flow rate of the coolant flowing into the flow control valve 1.

Meanwhile, the operation of the flow control valve 1 may be controlled based on the coolant temperature measured by the outlet water temperature sensor (WTS1), such that the method is needed that can accurately diagnose a failure of the outlet water temperature sensor (WTS1) for accurate operation of the flow control valve 1.

Accordingly, a failure diagnosis method of the present invention for diagnosing a failure of the outlet water temperature sensor (WTS1) may be configured to include a controller (C) determining whether or not it is in the flow stop state that stagnates the flow of the coolant by the flow control valve 1; the controller (C) obtaining an engine outlet coolant model temperature when it is determined to be in the flow stop state; and the controller (C) diagnosing the engine outlet coolant temperature sensor to be in a failure of the engine outlet coolant temperature sensor when the coolant model temperature is equal to or greater than a reference temperature and the flow stop state is maintained by the flow control valve 1.

The engine outlet coolant model temperature may be a coolant temperature determined based on operation conditions (a vehicle speed, an engine RPM, a gear stage number, an outside temperature, etc.) of the engine 20.

That is, to rapidly warm up the engine 20 at the initial stage of the vehicle start-up, all of the discharge ports of the flow control valve 1 are closed to be controlled so that the coolant flows only in the engine 20, but, when the coolant temperature is increased when a certain time elapses after the vehicle start-up, the operation of the flow control valve 1 is controlled based on the increased coolant temperature and thereby the flow stop state thereof is released.

However, when an abnormality occurs in the outlet water temperature sensor (WTS1), the flow control valve 1 is still in the flow stop state even if the coolant model temperature is increased to a certain temperature or more, and this means that the coolant temperature detecting value measured by the outlet water temperature sensor (WTS1) has not increased and may be diagnosed to be a failure situation of the outlet water temperature sensor (WTS1).

As described above, the present invention can diagnose the failure of the outlet water temperature sensor (WTS1) using the coolant model temperature to prevent the flow control valve 1 from staying in the flow stop state for a long time and thereby to prevent the coolant overheating of the engine 20 from being caused, thus preventing an accident risk due to overheating of the engine 20 and increasing the safety of the vehicle driving.

Furthermore, as another example of diagnosing a failure of the outlet water temperature sensor (WTS1), the present invention can be configured to further include storing a maximum value and a minimum value of the outlet coolant temperature measured by the engine outlet-side outlet water temperature sensor (WTS1), and diagnosing the engine outlet coolant temperature sensor to be in a failure of the outlet water temperature sensor (WTS1) when the difference between the maximum value and the minimum value of the outlet coolant temperature is within a certain range.

For example, after starting the vehicle, the outlet coolant temperature is measured by the outlet water temperature sensor (WTS1), and the maximum value and the minimum value of the outlet water temperature can be continuously updated and stored, respectively.

That is, when the outlet water temperature sensor (WTS1) is normal, the coolant temperature rapidly increases as the engine operation time elapses after the vehicle start-up, such that the difference between the maximum value and the minimum value thereof has to be a certain temperature or more; and as described above, when the difference between the maximum value and the minimum value thereof is not large, this means that the outlet coolant temperature sensing value has not increased and can be diagnosed to be a failure situation of the outlet water temperature sensor (WTS1).

Furthermore, as another example of diagnosing a failure of the outlet water temperature sensor (WTS1), the present invention can be configured to further include counting a flow stop time when it is determined to be in the flow stop state of the flow control valve 1 through the determining the flow stop, and diagnosing to be a failure of the outlet water temperature sensor (WTS1) when the flow stop time is equal to or greater than a reference time.

Herein, the reference time can be determined based on the coolant temperature measured by the engine inlet-side or outlet-side water temperature sensor upon start-up of the engine 20.

That is, when the outlet water temperature sensor (WTS1) is normal, the coolant temperature rapidly increases when the engine operation time elapses a certain time after the vehicle start-up, such that the flow stop state of the flow control valve 1 has to be released. As described above, it can be seen that the coolant temperature sensing value has not increased when the flow stop state of the outlet water temperature sensor (WTS1) is maintained for a long time, and this can be diagnosed to be a failure situation of the outlet water temperature sensor (WTS1).

Furthermore, as yet another example of diagnosing a failure of the outlet water temperature sensor (WTS1), the present invention may be configured to further include detecting an inlet coolant temperature and an outlet coolant temperature by the inlet water temperature sensor (WTS2) and the outlet water temperature sensor (WTS1), and diagnosing to be a failure of the engine outlet coolant temperature sensor when the inlet coolant temperature is greater than the outlet coolant temperature.

That is, when the outlet water temperature sensor (WTS1) is normal, the heat generation amount of the engine is added to the coolant flowed at the engine inlet and is output to the engine outlet coolant temperature, such that the inlet coolant temperature cannot be higher than the outlet coolant temperature. Accordingly, it can be seen that the outlet coolant temperature sensing value has not increased when the inlet coolant temperature is higher than the outlet coolant temperature, and this can be diagnosed to be a failure situation of the outlet water temperature sensor (WTS1).

Meanwhile, the present invention can be configured to further include releasing the flow stop state by operating the flow control valve 1 so that the coolant flows through the discharge port of the flow control valve 1 when it is diagnosed to be a failure of the outlet water temperature sensor (WTS1) in accordance with the above-described failure diagnosis method.

That is, it is possible to control to open at least one discharge port of the discharge ports of the flow control valve 1 connected to each flow path to flow the coolant through the opened discharge port, thus preventing the overheating phenomenon of the coolant by releasing the flow stop state.

It is possible to also control the flow control valve 1 to the location where all of the discharge ports of the flow control valve 1 are opened, and preferably to control the flow control valve 1 to operate to the location where the coolant flows as much as possible through the discharge port connected to the heater core.

That is, although it is general that the flow control valve 1 determines a port opening rate to become a flow stop state for quick warm-up at the initial stage of the vehicle start-up, the port opening rate can be also determined to a maximum heating state flowing a relatively large amount of coolant to the heater core side for implementing the maximum heating performance under the driving situation where a strong indoor heating is required, etc.

Accordingly, when the water temperature sensor fails, it is possible to control the flow control valve 1 to the maximum heating state, which is one of the settable locations at the initial stage of the vehicle start-up, thus making the circumstance that can control the opening or closing of the discharge port depending upon the following driving situation and controlling to drive the vehicle.

Figure 2:
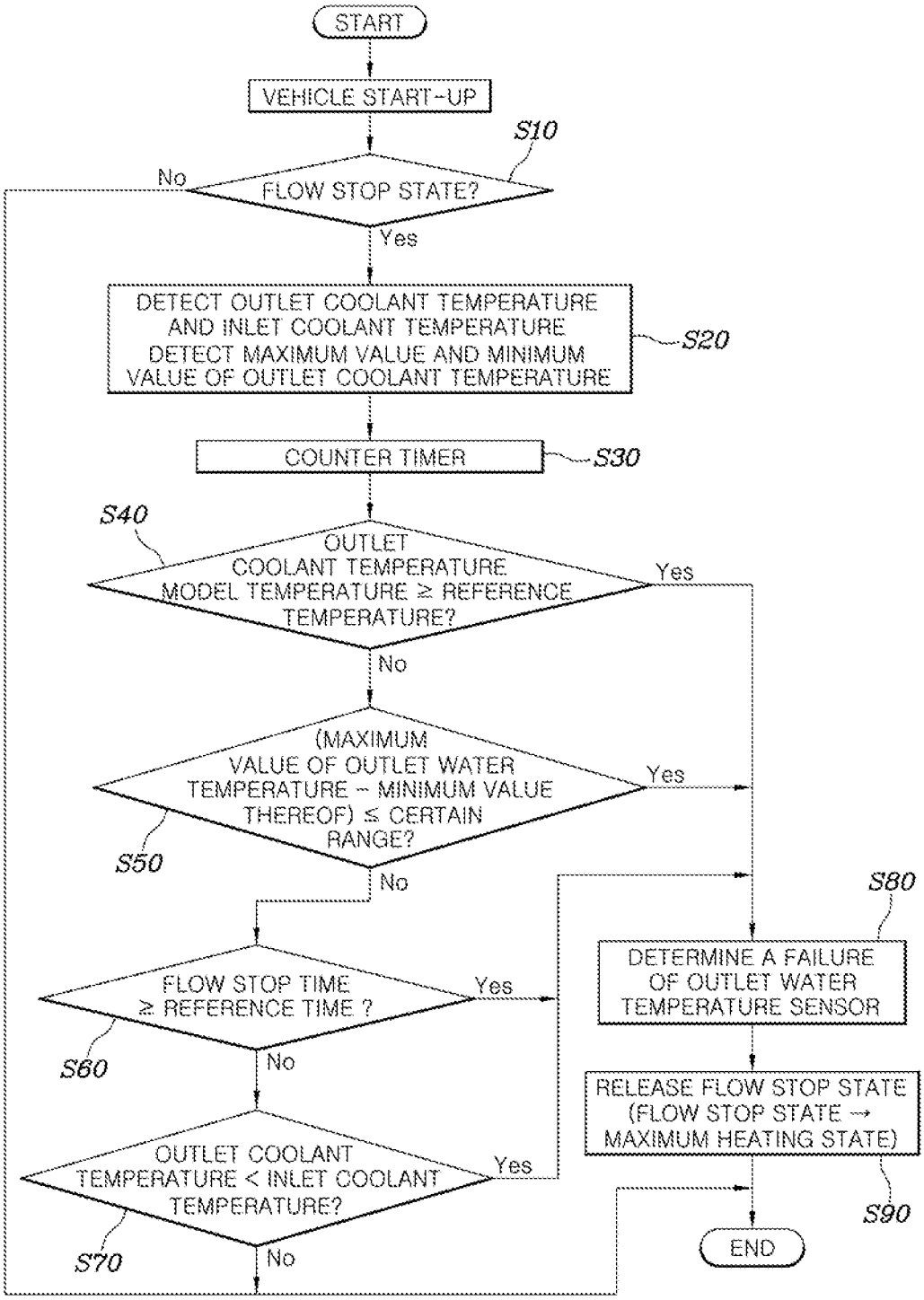
FIG. 2 is a flowchart illustrating a method of diagnosing a failure of a coolant temperature sensor in accordance with various aspects of the present invention.

Hereinafter, a failure diagnosis control procedure of the coolant temperature sensor for the vehicle in accordance with various aspects of the present invention will be referred to as a whole with reference to FIG. 2.

Upon the vehicle start-up, the flow control valve 1 determines whether or not it is in the flow stop state S10; when it is determined to be in the flow stop state, the maximum value and the minimum value of the outlet coolant temperature are detected S20; and the timer counting is started from the timing when the flow stop state has started after the vehicle start-up S30.

As such, it is determined whether or not the outlet coolant temperature model temperature is equal to or greater than a reference temperature S40, and when it is determined to be equal to or greater than the reference temperature, it is diagnosed as a failure of the outlet water temperature sensor (WTS1) S80.

On the other hand, when it is determined to be less than the reference temperature in the S40, it is determined whether or not the difference between the maximum value and the minimum value of the outlet coolant temperature is within a certain range S50, and when it is determined to be within the certain range, it is diagnosed as a failure of the outlet water temperature sensor (WTS1) S80.

On the other hand, when it is determined to be less than the reference time in the S60, it is determined whether or not the inlet coolant temperature exceeds the outlet coolant temperature S70, and when it is determined to exceed the outlet coolant temperature, it is diagnosed as a failure of the outlet water temperature sensor (WTS1) S80.

As such, when it is diagnosed as the failure of the outlet water temperature sensor (WTS1) in the S80, the flow control valve 1 is controlled to release the flow stop state so that the coolant flows through the discharge port of the flow control valve 1 S90.

As described above, the present invention diagnoses the failure of the outlet water temperature sensor (WTS1) in the flow stop state of the flow control valve 1 to prevent the flow control valve 1 from staying in the flow stop state for a long time, and thereby to prevent overheating of the coolant of the engine 20 from being caused, thus preventing the accident risk due to overheating of the engine 20 and increasing the safety of the vehicle driving.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A failure diagnosis method of an engine outlet-side outlet coolant temperature sensor for a vehicle, the failure diagnosis method comprising:

determining, by a controller, when a flow control valve is in a flow stop state that stagnates a flow of coolant by the flow control valve;

obtaining, by the controller, an engine outlet coolant model temperature determined based on operation conditions of the vehicle, when the flow control valve is in the flow stop state;

diagnosing, by the controller, the engine outlet-side outlet coolant temperature sensor to be in a failure, when the engine outlet coolant model temperature is equal to or greater than a reference temperature and when the flow stop state is maintained by the flow control valve for a predetermined time; and releasing, by the controller, the flow stop state by operating the flow control valve so that the coolant flows through a first discharge port of the flow control valve when the engine outlet-side outlet coolant temperature is diagnosed, by the controller, as the failure of the engine outlet-side coolant temperature sensor, wherein opening of the first discharge port is adjustable by the controller, wherein the flow control valve includes the first discharge port, a second discharge port connected to a heat exchanger and a third discharge port connected to a radiator, and an input port connected to an engine block, wherein openings of the second and third discharge ports and the input ports are adjustable by the controller, and wherein an engine head and the flow control valve are connected to each other and the engine outlet-side outlet coolant temperature sensor is mounted between the engine head and the flow control valve.

2. The failure diagnosis method of the engine outlet-side outlet coolant temperature sensor for the vehicle according to claim 1, wherein, in the releasing of the flow stop state, the controller is configured to operate the flow control valve so that the coolant flows maximally through the first discharge port connected to a heater core.

3. A failure diagnosis method of an engine outlet-side outlet coolant temperature sensor for a vehicle, the failure diagnosis method comprising:

determining, by a controller, when a flow control valve is in a flow stop state that stagnates a flow of coolant by the flow control valve;

diagnosing, by the controller, the engine outlet-side coolant temperature sensor to be in a failure, when a difference between a maximum value and a minimum value of outlet coolant temperature is within a predetermined range or diagnosing, by the controller, as the failure of the engine outlet-side coolant temperature sensor when an inlet coolant temperature is greater than the outlet coolant temperature and when the flow stop state is maintained by the flow control valve for a predetermined time.

4. The failure diagnosis method of the engine outlet-side outlet coolant temperature sensor for the vehicle according to claim 3, wherein the diagnosing, by the controller, as the failure of the engine outlet-side coolant temperature sensor when the difference between the maximum value and the minimum value of the outlet coolant temperature is within the predetermined range, includes:

storing, by the controller, the maximum value and the minimum value of the outlet coolant temperature measured by the engine outlet-side coolant temperature sensor; and diagnosing, by the controller, as the failure of the engine outlet-side coolant temperature sensor when the difference between the maximum value and the minimum value of the outlet coolant temperature is within the predetermined range.

5. The failure diagnosis method of the engine outlet-side outlet coolant temperature sensor for the vehicle according to claim 4, further including:

releasing, by the controller, the flow stop state by operating the flow control valve so that the coolant flows through a first discharge port of the flow control valve when the engine outlet-side outlet coolant temperature is diagnosed by the controller as the failure of the engine outlet-side coolant temperature sensor, wherein opening of the first discharge port is adjustable by the controller.

6. The failure diagnosis method of the engine outlet-side outlet coolant temperature sensor for the vehicle according to claim 5, wherein, in the releasing of the flow stop state, the controller is configured to operate the flow control valve so that the coolant flows maximally through the first discharge port connected to a heater core.

7. The failure diagnosis method of the engine outlet-side outlet coolant temperature sensor for the vehicle according to claim 6, wherein the flow control valve includes the first discharge port, a second discharge port connected to a heat exchanger and a third discharge port connected to a radiator, and an input port connected to an engine block, wherein openings of the second and third discharge ports and the input ports are adjustable by the controller, and wherein an engine head and the flow control valve are connected to each other and the engine outlet-side outlet coolant temperature sensor is mounted between the engine head and the flow control valve.

8. The failure diagnosis method of the engine outlet-side outlet coolant temperature sensor for the vehicle according to claim 3, wherein the diagnosing, by the controller, as the failure of the engine outlet-side coolant temperature sensor when the inlet coolant temperature is greater than the outlet coolant temperature, includes:

detecting, by the controller, the inlet coolant temperature and the outlet coolant temperature by an inlet coolant temperature sensor and the engine outlet-side coolant temperature sensor; and diagnosing, by the controller, as the failure of the engine outlet-side coolant temperature sensor when the inlet coolant temperature is greater than the outlet coolant temperature.

9. The failure diagnosis method of the engine outlet-side outlet coolant temperature sensor for the vehicle according to claim 8, further including:

releasing, by the controller, the flow stop state by operating the flow control valve so that the coolant flows through a first discharge port of the flow control valve when the engine outlet-side outlet coolant temperature is diagnosed as the failure of the engine outlet-side coolant temperature sensor, wherein opening of the first discharge port is adjustable by the controller.

10. The failure diagnosis method of the engine outlet-side outlet coolant temperature sensor for the vehicle according to claim 9, wherein, in the releasing of the flow stop state, the controller is configured to operate the flow control valve so that the coolant flows maximally through the first discharge port connected to a heater core.

11. The failure diagnosis method of the engine outlet-side outlet coolant temperature sensor for the vehicle according to claim 10, wherein the flow control valve includes the first discharge port, a second discharge port connected to a heat exchanger and a third discharge port connected to a radiator, and an input port connected to an engine block, wherein openings of the second and third discharge ports and the input ports are adjustable by the controller, and wherein an engine head and the flow control valve are connected to each other through the engine outlet-side outlet coolant temperature sensor.

12. A failure diagnosis method of an engine outlet-side outlet coolant temperature sensor for a vehicle, the failure diagnosis method comprising:

determining, by a controller, when a flow control valve is in a flow stop state that stagnates a flow of coolant by the flow control valve;

counting, by the controller, a flow stop time when the flow control valve is determined by the controller to be in the flow stop state; and diagnosing, by the controller, the engine outlet-side coolant temperature sensor to be in a failure, when the flow stop time is equal to or greater than a reference time and when the flow stop state is maintained by the flow control valve for a predetermined time.

13. The failure diagnosis method of the engine outlet-side outlet coolant temperature sensor for the vehicle according to claim 12, further including:

releasing, by the controller, the flow stop state by operating the flow control valve so that the coolant flows through a first discharge port of the flow control valve when the engine outlet-side outlet coolant temperature is diagnosed as the failure of the engine outlet-side coolant temperature sensor, wherein opening of the first discharge port is adjustable by the controller.

14. The failure diagnosis method of the engine outlet-side outlet coolant temperature sensor for the vehicle according to claim 13, wherein, in the releasing of the flow stop state, the controller is configured to operate the flow control valve so that the coolant flows maximally through the first discharge port connected to a heater core.

15. The failure diagnosis method of the engine outlet-side outlet coolant temperature sensor for the vehicle according to claim 14, wherein the flow control valve includes the first discharge port, a second discharge port connected to a heat exchanger and a third discharge port connected to a radiator, and an input port connected to an engine block, wherein openings of the second and third discharge ports and the input ports are adjustable by the controller, and wherein an engine head and the flow control valve are connected to each other through the engine outlet-side outlet coolant temperature sensor.

* * * * *